United States Patent [19]

Berczik et al.

[11] Patent Number: 4,543,132

[45] Date of Patent: Sep. 24, 1985

[54] PROCESSING FOR TITANIUM ALLOYS

[75] Inventors: Douglas M. Berczik, West Palm Beach; George Brodi, Palm Beach Gardens; Thomas E. O'Connell, North Palm Beach, all of Fla.

[73] Assignee: United Technologies Corporation, Hartford, Conn.

[21] Appl. No.: 547,270

[22] Filed: Oct. 31, 1983

[51] Int. Cl.[4] ..... C22F 1/18

[52] U.S. Cl. ..... 148/11.5 F; 148/12.7 B; 148/407; 148/421

[58] Field of Search ..... 148/11.5 F, 12.7 B, 148/421, 407

[56] References Cited

U.S. PATENT DOCUMENTS 3,748,194 7/1973 Ruckle et al. ..... 148/12.7 B 4,053,330 10/1977 Henricks et al. ..... 148/12.7 B 4,309,226 1/1982 Chen ..... 148/421

*Primary Examiner*—Wayland W. Stallard

*Attorney, Agent, or Firm*—Charles E. Sohl

[57] ABSTRACT

Process for improving the crack growth behavior of titanium alloys containing substantial beta stabilizers and at least 3% molybdenum, such as Ti-6-2-4-6. The process includes the steps of forging above the beta transus temperature, cooling at a controlled rate through the beta transus temperature, heating to a temperature between 50°-150° F. below the beta transus temperature, cooling the alloy at a rate in excess of that produced by air cooling, and aging the material between about 900° F. and 1100° F. The resultant material has substantially improved crack growth behavior when contrasted with material processed according to the prior art.

11 Claims, 4 Drawing Figures

500 X

PROCESSING FOR TITANIUM ALLOYS

Description

1. Technical Field

The present invention concerns the processing of high strength alpha beta titanium alloys, particularly alpha beta alloys containing substantial amounts of beta stabilizers and at least 3% molybdenum.

2. Background Art

High strength titanium alloys are widely used in aerospace applications. One such use is in discs in gas turbine engines. Gas turbine engine discs support and restrain compressor blades located at the periphery of the discs and are spun at speeds on the order of 10,000 rpm. During operation, substantial stresses are encountered and these stresses are usually, in part, cyclic. Such fluctuating stresses are known to cause fatigue failure. In the usual fatigue failure situation, a crack initiates, usually at a surface or subsurface flaw or defect, and then the crack grows or propagates as a result of the fluctuating stress. The growth of the crack decreases the area of the metal available to resist stress thereby increasing the effect of stress and causing more rapid crack growth rates.

It is obviously desirable that no fatigue failures occur. This, however, is usually not possible. It is also not possible to rely on the absence of fatigue failure in applications where such failures can cause injury. Accordingly, it is desirable that the fatigue crack, once it has initiated, should grow as slowly as possible. A slow crack growth rate permits the detection of such crack during routine inspections, before failure has occurred.

There are many processes for improving the various mechanical properties of titanium alloys. Most of these processes have focused upon the static properties of titanium such as yield and tensile strength and creep properties. The present invention specifically addresses the problem of the crack growth rate in a widely used titanium alloy, Ti-6-2-4-6.

U.S. Pat. Nos. 2,968,586 and 2,974,076 are early patents in the titanium field which describe the alpha beta class of titanium alloys and various possible thermomechanical sequences for such alloys. The '076 patent teaches that heat treatments involving quenching from above the beta transus temperature are not desirable in that they reduce the tensile strength and ductility of the alloys relative to quenching from below the beta transus temperature (Column 3, last full paragraph). Claims 8 and 9 of the '076 patent describe thermal processing involving heating to above the beta transus temperature, slowly cooling to below the beta transus temperature, equilibrating at a temperature near but below the beta transus temperature and rapidly quenching. No reference is made to deformation above the beta transus temperature. The '586 patent discusses quenching as a way of producing a Widmanstatten structure and teaches a cooling rate from about 3° per minute to about 30° per minute (Column 3, lines 23–25).

U.S. Pat. Nos. 3,901,743 and 4,053,330 are both assigned to the present assignee and relate to the processing of titanium alloys. The '743 patent specifically discussed the Ti-6-2-4-6 material and teaches a method comprising, starting with forged material, solution heat treating at a temperature slightly below the beta transus (the beta transus being 1735° F. and the suggested heat treatment being 1600°–1700° F.), quenching to room temperature, reheating to 1400°–1600° F. and subsequently aging at 950°–1100° F. Accordingly, it is not seen that this reference anticipates the present invention to be described below. The process described in the '330 patent includes the steps of forging in a temperature above the beta transus temperature, rapidly quenching to produce a Martensitic structure, and tempering at an intermediate temperature. The quenching is taught as being performed using a liquid media which would inherently produce the quench rate on the order of 1000° F. per minute.

U.S. Pat. No. 4,309,226 describes a thermomechanical process for the treatment of near alpha titanium alloys and specifically an alloy known as Ti-6-2-4-2 (6 Al, 4 Zr, 2 Mo, bal Ti). This process is similar in many respects to the present process but since it is applied to a substantially different alloy, a near alpha alloy rather than the present alloy which could be described as an alpha-beta alloy, the results obtained would not be those obtained by application of the process to the class of alloys described in this application. In particular, because of the low Mo content, there would be no formation of the Mo rich interface phase which is observed in material processed according to the present invention.

DISCLOSURE OF INVENTION

A class of titanium alloys, typified by Ti-6Al-2Sn-4Zr-6Mo, is thermomechanically processed to provide enhanced resistance to crack growth. The material is forged above the beta transus, cooled through the beta transus at 20°–100° F. /min, heat treated near but below the beta transus and aged.

The resultant structure comprises alpha platelets in a beta matrix, with the platelets being surrounded by a Mo rich zone, and the structure is also free from grain boundary alpha.

The structure is resistant to the propagation of fatigue cracks.

Other features and advantages will be apparent from the specification and claims and from the accompanying drawings which illustrate an embodiment of the invention.

BEST MODE FOR CARRYING OUT THE INVENTION

The present invention is a thermomechanical process for providing improved mechanical properties in certain titanium alloys. The process has been developed and optimized with respect to an alloy having a nominal composition of 6% Al, 2% Sn, 4% Zr, 6% Mo, balance essentially Ti (Ti-6-2-4-6) and will be described with respect to this alloy. The elemental ranges in this commercial alloy are all ±0.5% from the nominal except for Sn which is ±0.25% . It is believed that certain other alloys will also benefit the process. The major alternative commercial alloy which is believed to be amenable to the invention process is an alloy referred to as Ti-17 whose nominal composition is 5% Al, 2% Sn, 2% Zr, 4% Mo, 4% Cr, balance essentially Ti. Again the ranges are 0.5% except for Sn and Zr which are ±0.25%. These two alloys are alpha-beta alloys with a high beta stabilizer content (at least 10% by weight) so that the beta phase is relatively stable. These alloys are also high hardenability alloys, alloys of which thick sections can be fully hardened by quenching from above the beta solvus temperature. As discussed below the relatively high molybdenum content (>3% ) of the alloys is also significant.

The first step of the process is a forging step performed at a temperature above the beta transus temperature, preferably from about 25°-65° F. above the beta transus temperature. "Isothermal" forging has been employed using heated dies but reasonable forging temperature fluctuations, especially within the 25°-65° F. range are within the scope of the invention. The amount and rate of deformation are selected to be sufficient to recrystallize the material and to provide distorted or roughened grain boundaries. Typically a reduction equivalent to at least 10% and preferably at least 25% reduction in area will suffice.

Following the isothermal deformation step the material is cooled from the isothermal forging temperature (preferably below about 1000° F.) at a controlled rate. The rate is controlled to be from about 20° F. to about 100° F. per minute. This controlled rate cooling step is critical to providing the desired microstructure which will be described below. A slower cooling rate will lead to the formation of a coarse acicular structure which will not satisfactorily impede crack growth. If the rate is too high, the desired acicular microstructure will not be obtained.

The material is then heat treated at a temperature near but below the beta transus temperature, preferably from about 50° to about 150° F. below the beta transus temperature for a time of about 0.5-5 hrs. The material is cooled from this heat treatment temperature at a rate equivalent to that provided by air cooling or faster (preferably to a temperature below about 500° F.)

The final step in the process is an aging step performed at a temperature from about 900° to about 1200° F. for a time of 4-8 hrs.

Figure 1:
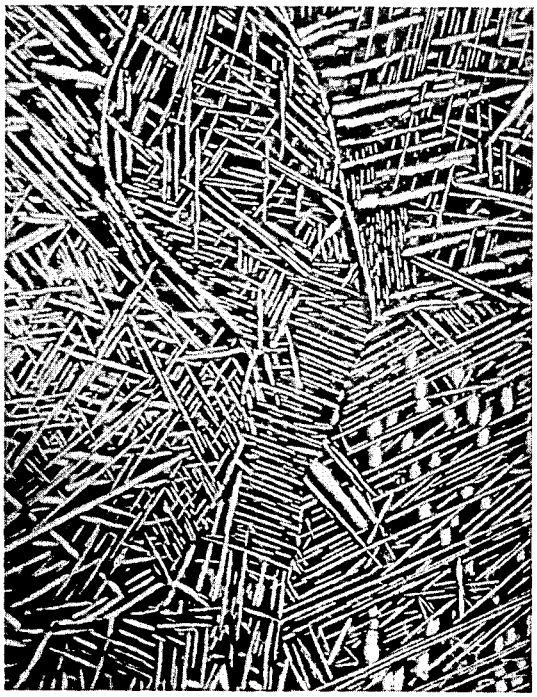
FIG. 1 is a photomicrograph of material processed according to the present invention.

The resultant structure is shown in FIG. 1 and consists of acicular alpha phase platelets surrounded by the beta phase. The length of the alpha platelets relative to their thickness is controlled by the cooling rate from the initial isothermal forging temperature and should be from about 4 to about 20. If the rate is too high, the platelets will be excessively thin (1/d too high) and will not provide the desired properties. A slow cooling rate results in a coarse structure which is not resistant to crack growth. When the structure of FIG. 1 is observed after cracks form, it is observed that the cracks propagate along the interface between the alpha needles and the beta matrix phase. For this reason it is desirable that the platelets not be too long and that the platelets have a jumbled "basket weave" morphology. If the platelet length is relatively small and the platelets are randomly oriented one to another, then the path of the propagating crack will be tortuous and the propagation of the crack will be slowed.

An observed feature of material processed according to the present invention is that there is a thin layer of a modified composition at the interface between the alpha platelets and the beta matrix. This interface composition has a high molybdenum content, on the order of 20-25% by weight. It is believed this material is tough, ductile and resistant to crack growth and that the invention process achieves a substantial benefit as a result of this interface phase. This high molybdenum interface material is believed to be developed during the heat treatment step. The thickness is on the order of 1000 Å. Because of its high molybdenum content it is anticipated that alloys which do not contain substantial (>3%) molybdenum levels will not produce the desirable crack growth behavior which is obtained in the Ti-6-2-4-6 material when processed according to the invention.

Some of the benefits of the present invention will be demonstrated in the following illustrative examples.

Figure 2:
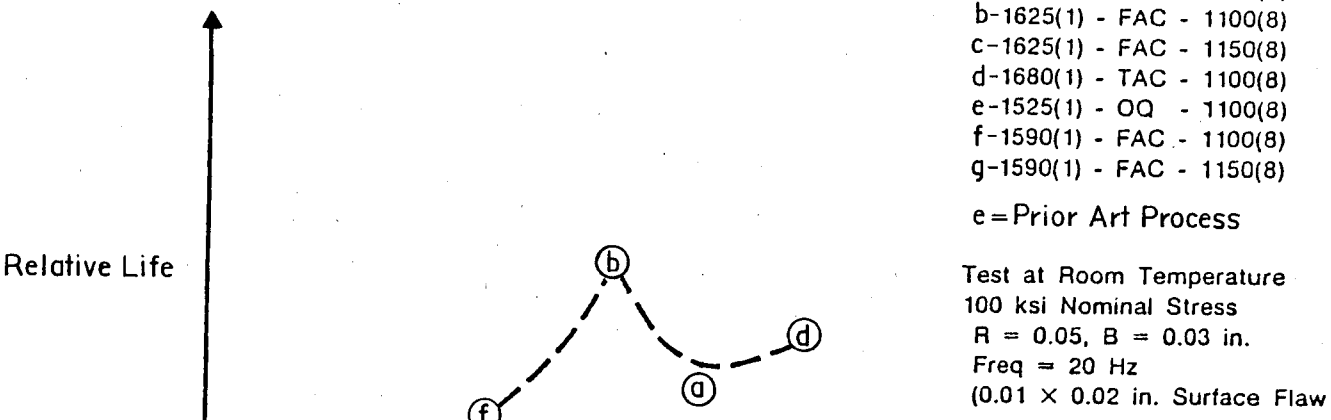
FIG. 2 shows crack growth life for Ti-6-4-2-6 material processed under a variety of conditions.

Ti-6-2-4-6 material (having a beta transus of about 1735° F.) was isothermally forged at 1800° F. to a reduction in area of about 66% . The material was then cooled at a rate of about 40° F. per minute to a temperature of 1000° F. (and then air cooled to room temperature). Samples of this material were then heat treated at various temperatures between 1590° F. and 1680° F., that is to say from about 145° F. to about 55° F. below the beta transus. Most of the samples were then aged at 1100° F. for 8 hrs. and evaluated in a test which provided a relative indication of crack growth rate. The results are plotted in FIG. 2. From FIG. 2 it can be seen that a temperature of about 1625° F. or 110° F. below the beta transus appears to provide the optimum crack growth rate. It also appears that the samples which were aged at 1100° F. had superior properties to those which were aged at 1150° F. Also as shown in the curve is a single point which illustrates behavior of material given a standard prior art processing sequence involving an oil quench from 1800° F. and subsequent heat treatment at 1525° F. It is evident that the present invention material was substantially superior to the prior art material.

Figure 3:
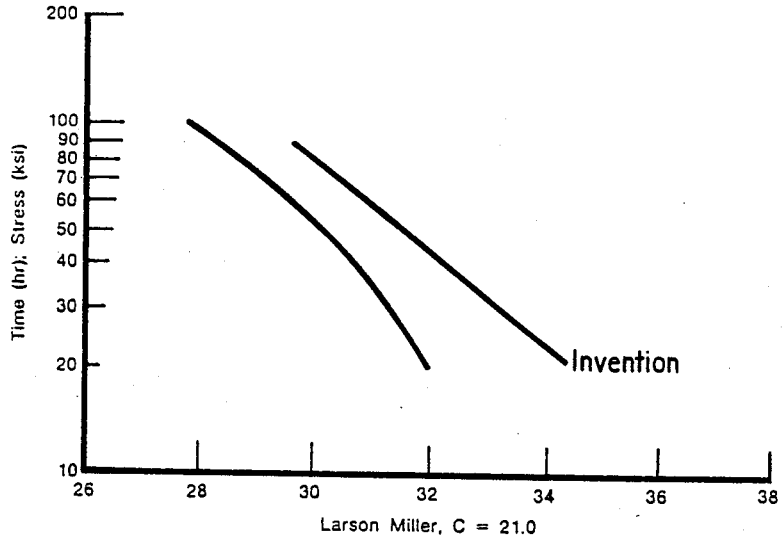
FIG. 3 compares the creep life for the present material to creep life for a prior art process.
Figure 4:
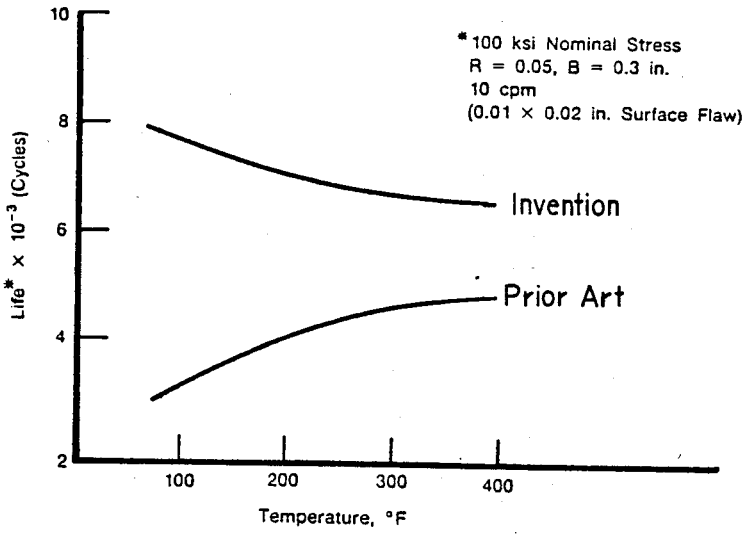
FIG. 4 compares crack growth rate as a function of temperature for material processed according to the present invention and for material processed according to the prior art.

FIG. 3 shows a Larson-Miller plot of the time to 1% creep for the invention material and material processed by a prior art process (subsolvus solution treatment, rapid cooling, aging at 1100° F.); it can be seen that for similar conditions of temperature and stress the invention material has about twice the creep life of the prior art material. Other tests were run in which the crack growth life as a function of temperature was evaluated for the invention material and the prior art material and the results are shown in FIG. 4. Again, it can be seen that the invention material is superior to the prior art (the same prior art process as the FIG. 3 material) material although the degree of superiority diminishes somewhat with increasing temperature.

It should be understood that the invention is not limited to the particular embodiments shown and described herein, but that various changes and modifications may be made without departing from the spirit and scope of this novel concept as defined by the following claims.

We claim:

1. Method for improving the crack growth behavior of alpha-beta titanium material containing substantial amounts of beta stabilizers and at least 3% Mo, and having a beta transus temperature, including the steps of a. forging the material above the beta transus an amount sufficient to produce recrystallization b. cooling the material, through the beta transus, at a rate of from about 20° to about 100° F. per minute c. heat treating the material at a temperature between about 50° and about 150° F. below the beta transus d. cooling the alloy at a rate equal to or in excess of that produced by air cooling e. aging the material.

2. Method as in claim 1 wherein the forging step is performed at between about 25° and 65° F. above the beta transus.

3. Method as in claim 1 wherein the material is forged an amount equivalent to at least a 10% reduction in area.

4. Method as in claim 1 wherein the material is forged an amount equivalent to at least a 25% reduction in area.

5. Method as in claim 1 wherein in step b, the material is cooled to below about 1000° F.

6. Method as in claim 1 wherein the heat treatment in step c is performed for about 0.5–5 hours.

7. Method as in claim 1 wherein in step d the material is cooled to below about 500° F.

8. Method as in claim 1 wherein in step e, the aging is performed between about 900° F. and 1100° F. for from about 2 to about 10 hours.

9. Method as in claim 1 wherein the alloy is Ti-6-2-4-6.

10. Method for thermomechanically processing titanium alloy articles (nominal composition 6% Al, 2% Sn, 4% Zr, 6% Mo, balance essentially Ti) including the steps of a. forging the material an amount equivalent to at least a 10% reduction area at a temperature between about 25% and about 65% above the gamma prime solvus b. cooling the material to below about 1000° F. at a rate between about 20° and above 100° F. per minute c. heat treating the material at a temperature between about 50° F. and 150° F. below the gamma prime solvus for about 0.5–5 hours d. cooling the material to below about 500° F. at a rate equal or in excess of that produced by air cooling e. aging the material for about 2–10 hours at a temperature between about 900° F. and about 1200° F.

11. A titanium alloy article resistant to crack growth which comprises:

a. a beta matrix containing b. from about 20 to about 90 volume percent alpha platelets having an average 1/d of between about 4 and about 20 c. said needles being surrounded by a thin layer having a high Mo content d. said material being substantially free of any continuous grain boundary alpha phase.

* * * * *